US006080360A

United States Patent [19]

Pfeffinger et al.

[11] Patent Number: 6,080,360

[45] Date of Patent: Jun. 27, 2000

[54] COATING FOR A CYLINDER OF A RECIPROCATING ENGINE

[75] Inventors: Harald Pfeffinger, Tiefenbronn; Micheal Voit, Remseck; Tilman Haug, Uhldingen-Muehlhof; Patrick Izquierdo; Herbert Gasthuber, both of Ulm; Wolfgang Reichle, Lenningen; Axel Heuberger, Wildberg; Franz Rueckert, Ostfildern; Peter Stocker, Sulzbach; Helmut Proefrock, Leutenbach, all of Germany

[73] Assignee: DaimlerChrysler AG, Germany

[21] Appl. No.: 09/127,795

[22] Filed: Aug. 3, 1998

[30] Foreign Application Priority Data

Aug. 1, 1997 [DE] Germany ..... 197 33 205

[51] Int. Cl.[7] ..... C22C 21/04

[52] U.S. Cl. ..... 420/534; 420/537; 420/546; 427/576; 427/452; 427/456

[58] Field of Search ..... 420/534, 537, 420/546; 427/576

[56] References Cited

U.S. PATENT DOCUMENTS

| | | | |
|---|---|---|---|
| 4,707,379 | 11/1987 | Neufuss et al. | 427/34 |
| 5,891,273 | 4/1999 | Ruckert et al. | 148/523 |

FOREIGN PATENT DOCUMENTS

| | | |
|---|---|---|
| 0 411 577 B1 | 2/1991 | European Pat. Off. . |
| 0 526 079 B1 | 2/1991 | European Pat. Off. . |
| 39 41 381 A1 | 6/1991 | Germany . |
| 43 28 619 C2 | 8/1995 | Germany . |
| 44 38 550 A1 | 5/1996 | Germany . |
| 8-225915 | 9/1996 | Japan . |
| WO 97/13884 | 4/1997 | WIPO . |

OTHER PUBLICATIONS

Patent Abstracts of Japan, 56166368, Dec. 21, 1981, Kato Shinji.

Patent Abstracts of Japan, 59219468, Dec. 10, 1984, Shimizu Yoichi.

Patent Abstracts of Japan, 58064371, Apr. 16, 1983, Kaneko Toshiki.

Patent Abstracts of Japan, 56102546, Aug. 17, 1981, Kato Shinji.

Patent Abstracts of Japan, 05305492, Nov. 19, 1993, Shioda Shunta.

Patent Abstracts of Japan, 06330274, Nov. 29, 1994, Fujinaga Minoru.

Dr. Hans K. Pulker et al., "Verschleiss–Schutzschichten unter Anwendung der CVD/PVD–Verfahren," expert Verlag Sindelfingen 1985, pp. 23–25.

*Primary Examiner*—Daniel J. Jenkins
*Assistant Examiner*—Nicole Coy
*Attorney, Agent, or Firm*—Evenson, McKeown, Edwards & Lenahan, P.L.L.C.

[57] ABSTRACT

A coating for a cylinder bore of a reciprocating engine with an iron, aluminum, or magnesium base comprises a hypereutectic aluminum/silicon alloy. The alloy is applied to a cylinder wall by thermal spraying.

23 Claims, 1 Drawing Sheet

COATING FOR A CYLINDER OF A RECIPROCATING ENGINE

BACKGROUND AND SUMMARY OF THE INVENTION

This application claims the priority of German Patent Application No. 197 33 205.6, filed Aug. 1, 1997, the disclosure of which is expressly incorporated by reference herein.

The present invention relates to a coating for a cylinder of a reciprocating engine based on iron, aluminum, or magnesium with a hypereutectic aluminum/silicon alloy and/or an aluminum-silicon composite material, as well as a method for manufacturing this coating, both of which are employed in industry.

In automobile construction, at the present time, most of the gray cast iron crankcases of reciprocating engines that are dominant today (their share in 1994 in Germany was still a dominant 96% and 82% Europe-wide) are gradually being displaced by those made of lightweight metals in order to reduce the total weight of the vehicle and hence to improve fuel consumption. Diecasting of low-alloyed aluminum such as AlSi10 for manufacturing crankcases from lightweight metal will initially qualify for economic and technical reasons. However, such alloys, in contrast to the atmospheric casting of hypereutectic aluminum-silicon alloys such as ALUSIL™ (AlSi17) that have become established in engine-building but are much more expensive, exhibit unsatisfactory behavior regarding abrasion and wear when in contact with aluminum pistons and piston rings, and are therefore unsuitable as friction partners.

Therefore, the casting of tribologically suitable liners made of gray cast iron or hypereutectic aluminum-silicon cannot be eliminated in making future engines. To manufacture these liners in accordance with DE 43 28 619 C2 or DE 44 38 550 A1 for example, blanks are manufactured by the known Ospray method and then compacted mechanically. A slightly different approach is presented in EP 0 411 577 B1 , in which a hypereutectic alloy is sprayed in the molten state from a first nozzle while solid silicon particles are sprayed at the same time from another nozzle onto a carrier device where they harden to form a block. The semifinished liners, prior to casting, are placed in the casting mold first and then molten aluminum is poured over them. The typical wall thickness of such liners is 2–3 mm. Then the interior of the liners is coarse- and fine-turned, honed, and laid bare. This solution involves disadvantages in terms of design, manufacturing techniques, and economy, such as limited adhesion of the AlSi10 melt to the liner surface, costly handling, and high price. Moreover, the wall thickness of the linings influences the minimum distance between cylinders. Especially in future small engines, the spacing should be as close as possible because it helps determine the minimum external dimensions of the engine.

Thermal spraying offers further opportunities to apply wear-resistant coatings to cylinders in crankcases. The basic principle of thermal spraying consists in a meltable or partially meltable material being melted in a high-speed hot gas stream to form small spray droplets and then being accelerated toward the surface to be coated (DIN 32530). Upon impact, the sprayed droplets solidify when they strike the relatively cold metal surface and form layer upon layer to create a coating. The advantage of this coating technique over electrodeposition, chemical or physical gas phase deposition, and the like, is the high application rate that makes it possible to coat a cylinder economically in a few minutes. The methods of thermal spraying differ in terms of the way they are performed and in the properties of the high-speed hot gas stream.

The goal of the present invention is to develop a coating for cylinders that allows high-quality coatings to be produced simply and economically. It is also the goal of the invention to provide a method by which such coatings can be applied.

As a result of the present invention, following the actual process of diecasting, the cylinders of a diecast engine block that are preferably based on iron or lightweight metals, especially aluminum and magnesium, can be coated directly with a wear-resistant layer of aluminum and silicon using a thermal spraying method, so that the previously conventional and expensive lining solution is replaced. Another advantage is that the thickness of the actual tribological layer on the crankcase, which itself does not have good tribological properties but is easy to cast and to machine, is considerably reduced. At 0.1 to 0.2 mm, it is less than 1/10 of the liner wall thickness conventionally used today and therefore offers the possibility of building much more compact engines.

Plasma spraying is used in particular to produce the wear-resistant aluminum-silicon coating, because with this nonequilibrium method, grain structures can be formed that otherwise cannot be produced metallurgically. Because of the high energy density and the large number of parameters in the method, oxides for example can be formed almost by definition in the layer structure of the coating. The oxides make a significant contribution to the wear resistance of the coating. In addition, by using agglomerated spray powders, any foreign materials can be added to the coating including those with melting points that differ significantly from that of the aluminum alloy, such as hard metal or ceramic particles as well as dry lubricants.

It is also especially advantageous that the coating according to the present invention can be integrated into mass production without changing the manufacturing equipment already installed today, so that the expensive manufacture and handling of the cylinder linings can be eliminated and considerable amounts of material can be saved. For this to happen, the coating must be applied at high rates and especially short cycles.

Moreover, the coating can also be applied with a very close fit to the shape of the cylinder bore in the crankcase and thus a fine surface quality can be produced, and costly finishing steps such as preliminary turning and fine turning can be eliminated to reduce manufacturing costs significantly.

By using special aluminum/silicon spray powder to produce the coating in atmospheric thermal spraying methods, a heterogeneous layer structure is created during the formation of the coating, with layers made of aluminum mixed crystals, silicon precipitates or particles, intermetallic phases such as $Al_2Cu$ and $Mg_2Si$, and extremely finely divided oxides, with the formation and distribution of the oxides being attributed exclusively to the nonequilibrium properties of the atmospheric thermal spraying method. The finely divided oxides lend the coating extraordinarily good resistance to wear.

Atmospheric plasma spraying is favored for producing the wear-resistant aluminum/silicon coating by atmospheric thermal spraying because of the ready melting of the spray particles that favors good adhesion to the substrate and moderate transfer of heat into the part.

Other objects, advantages and novel features of the present invention will become apparent from the following detailed description of the invention when considered in conjunction with the accompanying drawings.

DETAILED DESCRIPTION OF THE DRAWINGS

Figure 1:
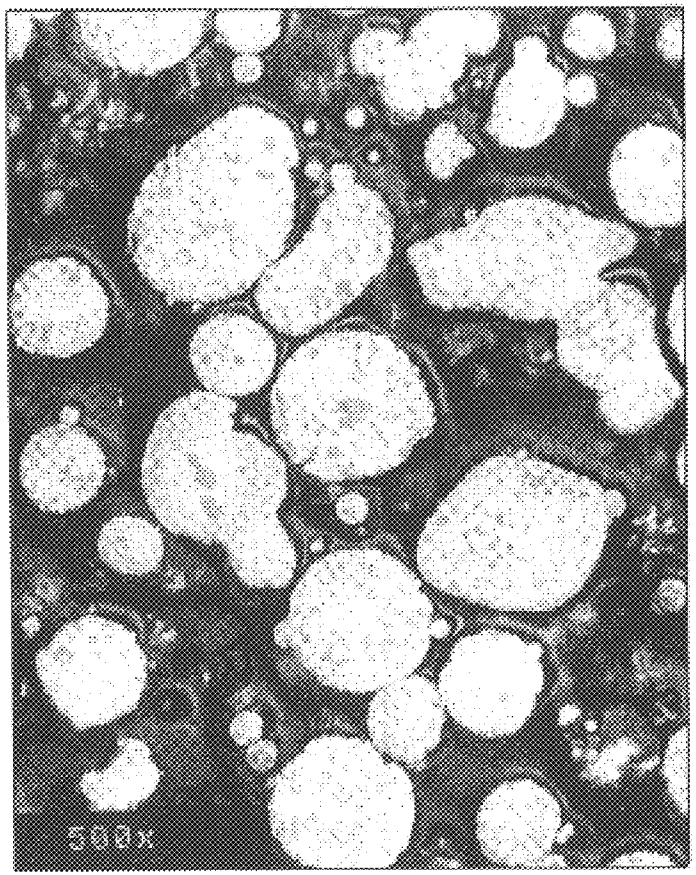
FIG. 1 shows a polished section of spherical spray particles from alloy A.
Figure 2:
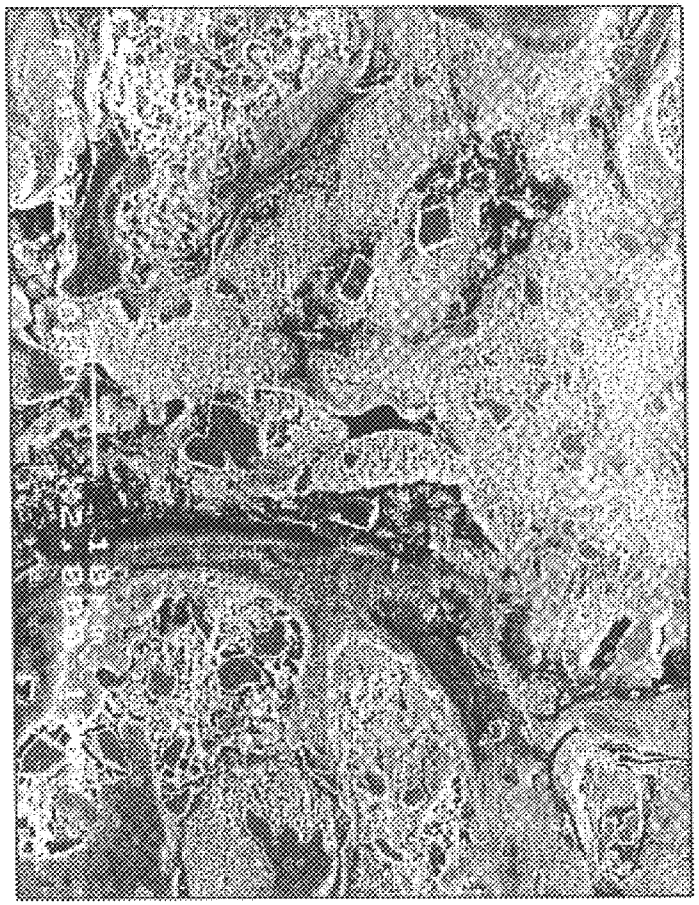
FIG. 2 is a scanning electron photomicrograph of a plasma-sprayed coating.

In order to produce the coatings shown in FIGS. 1 and 2, spray powders made of aluminum/silicon alloys and/or aluminum/silicon composite materials were developed. In addition to optimizing the composition, emphasis was placed on the shape of the individual spray powder particles, the powder grain distribution, and the flow behavior of the spray powder. For example, two aluminum/silicon alloy systems were selected as the spray powder, with one alloy A (see FIG. 1) being used for working with iron-coated pistons in particular, and another alloy B (see FIG. 2) being preferably used for uncoated pistons.

Examples of alloys are shown in the examples below, with the numbers representing content in weight percent:

EXAMPLE 1

Alloy A is composed as follows, with the numbers representing content in weight percent:
Silicon, 23.0 to 40.0%, preferably approximately 25%;
magnesium, 0.8 to 2.0%, preferably approximately 1.2%;
copper, maximum 4.5%, preferably approximately 3.9%;
zirconium, maximum 0.6%;
iron, maximum 0.25%;
manganese, nickel, and zinc, maximum of 0.01% each; and remainder aluminum.

EXAMPLE 2

Alloy B differs from alloy A by a slightly higher content of iron and nickel:
silicon, 23.0 to 40.0%, preferably approximately 25%;
nickel, 1.0 to 5.0%, preferably approximately 4%;
iron, 1.0 to 1.4%, preferably approximately 1.2%;
magnesium, 0.8 to 2.0%, preferably approximately 1.2%;
copper, maximum 4.5%, preferably approximately 3.9%;
zirconium, maximum 0.6%;
manganese and zinc, maximum of 0.01% each; and remainder aluminum.

The four alloys C, D, E, and F are composed as follows, with the numbers representing content in weight percent.

EXAMPLE 3

Alloy C:
silicon, 0 to 11.8%, preferably approximately 9%;
magnesium, 0.8 to 2.0%, preferably approximately 1.2%;
copper, maximum 4.5%, preferably approximately 3.9%;
zirconium, maximum 0.6%;
iron, maximum 0.25%;
manganese, nickel, and zinc, maximum of 0.01% each; and remainder aluminum.

EXAMPLE 4

Alloy D:
silicon, 0 to 11.8%, preferably approximately 9%;
nickel, 1.0 to 5.0%, preferably approximately 4%;
iron, 1.0 to 1.4%, preferably approximately 1.2%;
magnesium, 0.8 to 2.0%, preferably approximately 1.2%;
copper, maximum 4.5%, preferably approximately 3.9%;
zirconium, maximum 0.6%;
manganese and zinc, maximum of 0.01% each; and remainder aluminum.

EXAMPLE 5

Alloy E:
silicon, 11.8 to 40.0%, preferably approximately 17%;
magnesium, 0.8 to 2.0%, preferably approximately 1.2%;
copper, maximum 4.5%, preferably approximately 3.9%;
zirconium, maximum 0.6%;
iron, maximum 0.25%;
manganese, nickel, and zinc, maximum of 0.01% each; and remainder aluminum.

EXAMPLE 6

Alloy F:
silicon, 11.8 to 40%, preferably approximately 17%;
nickel, 1.0 to 5.0%, preferably approximately 4%;
iron, 1.0 to 1.4%, preferably approximately 1.2%;
magnesium, 0.8 to 2.0%, preferably approximately 1.2%;
copper, maximum 4.5%, preferably approximately 3.9%;
zirconium, maximum 0.6%;
manganese and zinc, maximum of 0.01% each; and remainder aluminum.

FIG. 1 shows a polished section,of the spherical spray particles in alloy A, in which the aluminum mixed-crystal structure and the Si primary precipitates are clearly visible.

In FIG. 2, a scanning electron photomicrograph of a plasma-sprayed layer is shown that was produced with the spray powder of alloy A. The section was etched in order to attack the aluminum mixed crystal and thus make the lattice structure clearer. In addition to the silicon primary precipitates, the structure consists of primary aluminum mixed crystal dendrites in which the dendrite arms are sheathed by eutectic silicon. The size of the dendrite arms varies considerably, so that they can be dissolved only conditionally. The variations in the fineness of the existing structure are due to the fluctuations in the temperature and speed of individual drops in the melt and also to variations in nucleus formation when various melted drops harden. Such a fine structure characterizes thermally sprayed layers by contrast with the structures obtained by powder-metallic methods and is responsible for the good wear resistance of these layers.

Aluminum/silicon composite powders were developed to increase the percentage of coarse Si particles in the layer. The agglomerated composite powders consist of fine silicon particles and fine metallic particles of an aluminum/silicon alloy, bonded together by inorganic or organic binders, with the percentage of silicon particles being 5 to 50% and the percentage of alloy particles being 50 to 95%. The silicon particles have an average grain size of 0.1 to 10.0 $\mu$m, preferably approximately 5 $\mu$m. The metallic particles have an average particle size of 0.1 to 50.0 $\mu$m, preferably approximately 5 $\mu$m and consist of both alternatively usable hypoeutectic alloys C or D or of both alternatively usable hypereutectic alloys E or F. Using hypereutectic alloy particles preserves the percentage of aluminum mixed crystals in the layer structure, while the formation of aluminum mixed crystals in the layer structure is suppressed by using hypoeutectic aluminum/silicon particles.

The coating of a cylinder bore according to the present invention assumes that the lightweight metal block is cast in the usual fashion by diecasting methods but without placing cylinder liners in the mold. The cylinder bore in the crankcase is then preturned coarsely in one workstep in order to provide the necessary shape and position tolerances. Then the aluminum-silicon coating is applied. The coating process can either be performed in the mold, so that a suitable commercially available internal burner can be introduced into the bore that rotates around the central axis of the cylinder and is moved axially, or a nonrotating burner is introduced into the cylinder bore of the rotating crankcase and is guided along the central axis of the cylinder in order to spray the coating nearly at right angles to the cylinder wall. The latter is simpler from the methodology standpoint and is safer since the application of the required media such as electrical energy, cooling water, primary and secondary gases, and spray powder by a rotating assembly poses problems.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A coating for a cylinder bore of a reciprocating engine, comprising:

a hypereutectic aluminum/silicon alloy having a heterogeneous layer structure comprising aluminum mixed crystal, silicon primary precipitates, intermetallic phases, and oxides;

wherein the average size of the silicon primary precipitates is less than 10 $\mu$m, and the average size of the oxides is less than 5 $\mu$m.

2. The coating according to claim 1, wherein said intermetallic phases are $Al_2Cu$ or $Mg_2Si$.

3. A coating for a cylinder bore of a reciprocating engine, comprising:

an aluminum/silicon composite material having a heterogeneous layer structure comprising aluminum mixed crystal, embedded silicon particles, intermetallic phases of $Al_2Cu$ and $Mg_2Si$, and oxides;

wherein the average size of the embedded silicon particles is less than 10 $\mu$m, and the average size of the oxides is less than 5 $\mu$m.

4. A coating for a cylinder bore of a reciprocating engine, comprising:

an aluminum/silicon composite material having comprising a heterogeneous layer structure comprising aluminum mixed crystal, embedded silicon particles, silicon precipitates, intermetallic phases of $Al_2Cu$ and $Mg_2Si$, and oxides;

wherein the average size of the silicon primary precipitates and silicon particles is less than 10 $\mu$m and the average size of the oxides is less than 5 $\mu$m.

5. A method for producing a coating for a cylinder bore of a reciprocating engine comprising a hypereutectic aluminum/silicon alloy having a heterogeneous layer structure comprising aluminum mixed crystal, silicon primary precipitates, intermetallic phases, and oxides, wherein the average size of the silicon primary precipitates is less than 10 $\mu$m, and the average size of the oxides is less than 5 $\mu$m; said method comprising:

thermal spraying the alloy; and forming the oxides by adjusting the spray parameters.

6. A method according to claim 5, wherein said thermal spraying is an atmospheric plasma spraying.

7. A method for producing a coating for a cylinder bore of a reciprocating engine comprising an aluminum/silicon composite material having a heterogeneous layer structure comprising aluminum mixed crystal, embedded silicon particles, intermetallic phases of $Al_2Cu$ and $Mg_2Si$, and oxides, wherein the average size of the embedded silicon particles is less than 10 $\mu$m, and the average size of the oxides is less than 5 $\mu$m, said method comprising:

thermal spraying the alloy; and forming the oxides by adjusting the spray parameters.

8. A method for producing a coating for a cylinder bore of a reciprocating engine comprising an aluminum/silicon composite material having comprising a heterogeneous layer structure comprising aluminum mixed crystal, embedded silicon particles, silicon precipitates, intermetallic phases of $Al_2Cu$ and $Mg_2Si$, and oxides, wherein the average size of the silicon primary precipitates and silicon particles is less than 10 $\mu$m and the average size of the oxides is less than 5 $\mu$m, said method comprising:

thermal spraying the alloy; and forming the oxides by adjusting the spray parameters.

9. The method according to claim 5, wherein said thermal spraying comprises spraying a starting material comprising:

23.0 to 40.0 wt. % silicon;

0.8 to 2.0 wt. % magnesium;

4.5 wt. % copper;

maximum 0.6 wt. % zirconium;

maximum 0.25 wt. % iron;

maximum of 0.01 wt. % manganese, nickel and zinc each; and remainder aluminum.

10. The method according to claim 9, wherein said starting material comprises 25 wt. % Si; 1.2 wt. % Mg; and 3.9 wt. % Cu.

11. The method according to claim 5, wherein said thermal spraying comprises spraying a starting material comprising:

23.0 to 40.0 wt. % silicon;

1.0 to 5.0 wt. % nickel;

1.0 to 1.4 wt. % iron;

0.8 to 2.0 wt. % magnesium;

maximum 4.5 wt. % copper;

maximum 0.6 wt. % zirconium;

maximum of 0.01 wt. % manganese and zinc each; and remainder aluminum.

12. The method according to claim 11, wherein said starting material comprises 25 wt. % Si; 4 wt. % Ni; 1.2 wt. % Fe; 1.2 wt. % Mg; and 3.9 wt. % Cu.

13. The method according to claim 7, wherein said thermal spraying comprises spraying a starting material comprising an agglomerated composite powder made of fine silicon particles and fine metallic particles, bound together by an inorganic or organic binder, said composite powder comprising:

0 to 11.8 wt. % silicon;

0.8 to 2.0 wt. % magnesium;

maximum 4.5 wt. % copper;

maximum 0.6 wt. % zirconium;

maximum 0.25% iron;

maximum of 0.01 wt. % manganese, nickel and zinc each;

and remainder aluminum, wherein the percentage of silicon particles is 5 to 50% and the percentage of alloy particles is 50 to 95%, with the silicon particles having an average grain size of 0.1 to 10.0

μm and the metal particles having an average grain size of 0.1 to 50.0 μm.

14. The method according to claim 13, wherein the silicon particles have an average grain size of approximately 5 μm and the metal particles have an average grain size of approximately 5 μm.

15. The method according to claim 13, wherein said composite powder comprises 9 wt. % Si; 1.2 wt. % Mg; and 3.9 wt. % Cu.

16. The method according to claim 7, wherein said thermal spraying comprises spraying a starting material comprising an agglomerated composite powder made of fine silicon particles and fine metallic particles, bound together by an inorganic or organic binder, said composite powder comprising:

0 to 11.8 wt. % silicon;

1.0 to 5.0 wt. % nickel;

1.0 to 1.4 wt. % iron;

0.8 to 2.0 wt. % magnesium;

maximum 4.5 wt. % copper;

maximum 0.6 wt. % zirconium;

maximum of 0.01 wt. % manganese and zinc each;

and remainder aluminum, wherein the percentage of silicon particles is 5 to 50% and the percentage of alloy particles is 50 to 95%, with the silicon particles having an average grain size of 0.1 to 10.0 μm, and the metal particles having an average grain size of 0.1 to 50.0 μm.

17. The method according to claim 16, wherein said composite powder comprises 9 wt. % Si; 4 wt. % Ni; 1.2 wt. % Fe, 1.2 wt. % Mg; and 3.9 wt. % Cu.

18. The method according to claim 8, wherein said thermal spraying comprises spraying a starting material comprising an agglomerated composite powder made of fine silicon particles and fine metallic particles, bound together by an inorganic or organic binder, said composite powder comprising:

11.8 to 40 wt. % silicon;

0.8 to 2.0 wt. % magnesium;

maximum 4.5 wt. % copper;

maximum 0.6 wt. % zirconium;

maximum 0.25 wt. % iron;

maximum of 0.01 wt. % manganese, nickel and zinc each;

and remainder aluminum, wherein the percentage of silicon particles is 5 to 50% and the percentage of alloy particles is 50 to 95%, with the silicon particles having an average grain size of 0.1 to 10.0 μm, and the metal particles having an average grain size of 0.1 to 50.0 μm.

19. The method according to claim 18, wherein said composite powder comprises 17 wt. % Si; 1.2 wt. % Mg; and 3.9 wt. % Cu.

20. The method according to claim 8, wherein said thermal spraying comprises spraying a starting material comprising an agglomerated composite powder made of fine silicon particles and fine metallic particles, bound together by an inorganic or organic binder, said composite powder comprising:

11.8 to 40 wt. % silicon;

1.0 to 5.0 wt. % nickel;

1.0 to 1.4 wt. % iron;

0.8 to 2.0 wt. % magnesium;

maximum 4.5 wt. % copper;

maximum 0.6 wt. % zirconium;

maximum of 0.01 wt. % manganese and zinc each;

and remainder aluminum, wherein the percentage of silicon particles is 5 to 50% and the percentage of alloy particles is 50 to 95%, with the silicon particles having an average grain size of 0.1 to 10.0 μm, the metal particles having an average grain size of 0.1 to 50.0 μm.

21. The method according to claim 20, wherein said composite powder comprises 17 wt. % Si; 4 wt. % Ni; 1.2 wt. % Fe; 1.2 wt. % Mg; and 3.9 wt. % Cu.

22. The method according to claim 9, further comprising:

mounting an internal burner on a rotating assembly; and inserting, rotating and axially moving the internal burner around the central axis of a cylinder bore;

wherein said spraying comprises spraying the coating onto a cylinder wall.

23. The method according to claim 9, further comprising:

introducing an internal burner into a cylinder bore of a rotating crankcase; and axially moving said burner along the central axis of the cylinder bore;

wherein said spraying comprises spraying the coating onto a cylinder wall.

* * * * *